US007223130B2

(12) United States Patent
Osada et al.

(10) Patent No.: US 7,223,130 B2
(45) Date of Patent: May 29, 2007

(54) ELECTRICAL CONNECTOR

(75) Inventors: Tsuyoshi Osada, Farmington Hills, MI (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/130,752

(22) Filed: May 17, 2005

(65) Prior Publication Data

US 2006/0264081 A1 Nov. 23, 2006

(51) Int. Cl.
*H01R 13/514* (2006.01)

(52) U.S. Cl. ..... 439/752; 439/157; 439/488

(58) Field of Classification Search ..... 439/752, 439/157, 372, 159, 152, 488–489, 153, 347, 439/266, 296, 345, 352, 341–343, 154–156
See application file for complete search history.

(56) References Cited

U.S. PATENT DOCUMENTS

| | | | | |
|---|---|---|---|---|
| 6,213,795 | B1 * | 4/2001 | Drescher et al. | 439/157 |
| 6,270,376 | B1 | 8/2001 | Fink et al. | |
| 6,565,372 | B2 * | 5/2003 | Bakker et al. | 439/157 |
| 6,824,406 | B1 * | 11/2004 | Sharples et al. | 439/157 |
| 6,893,276 | B2 * | 5/2005 | Munoz et al. | 439/157 |
| 6,960,090 | B2 * | 11/2005 | Denter et al. | 439/157 |

FOREIGN PATENT DOCUMENTS

| | | | |
|---|---|---|---|
| DE | 197 42 647 | A1 | 4/1999 |
| EP | 1 049 209 | A1 | 11/2000 |
| EP | 1 054 477 | A1 | 11/2000 |
| EP | 1 306 931 | A1 | 5/2003 |
| EP | 1 445 838 | A1 | 8/2004 |
| WO | WO-02078128 | A2 | 10/2002 |

OTHER PUBLICATIONS

Abstract of German Publication No. DE19742647 dated Apr. 22, 1999 (1 page).

International Search Report of Corresponding PCT Application No. PCT/US2006/000772 dated May 30, 2006 (6 pages).

* cited by examiner

*Primary Examiner*—Truc T. Nguyen
*Assistant Examiner*—Edwin A. Leon
(74) *Attorney, Agent, or Firm*—Osha Liang LLP

(57) ABSTRACT

An electrical connector includes a housing, a lever, and a TPA member. The housing includes a front portion to receive terminals of a mating connector and a rear portion to receive a plurality of wiring harnesses. The housing also includes a TPA slot into which the TPA member is inserted. The lever include an interference portion and is disposed on the housing body so as to rotated within a range between a predetermined position and a final position, thereby functioning as an insertion-assist mechanism. The TPA member is to assure a proper position of the terminals of the wiring harnesses inserted, engaging with the terminals. When the TPA member is improperly inserted into the housing, the interference portion comes into interference with, in accordance with rotational movement of the lever, a portion of the TPA member that protrudes from the surface of the housing.

14 Claims, 9 Drawing Sheets

ELECTRICAL CONNECTOR

BACKGROUND OF INVENTION

1. Field of the Invention

The invention relates generally to electrical connectors, and particularly to an electrical connector with a terminal assurance position member that assures a proper position of terminals of wiring harnesses to be installed into the electrical connector.

2. Background Art

An electrical connector is a core component used in many electric systems to connect wiring harnesses. Connectors are typically manufactured by a connector manufacturer, and thereafter supplied to a harness assembler to install wiring harnesses thereinto. The connectors attaching the wiring harnesses are further supplied to a downstream assembler to be installed into electric systems, combining with mating connectors.

A connector for a specific application, among other things, a connector for an automotive electric system, may include a terminal position assurance (TPA) member for installing the wiring harnesses. The TPA member is a piece to assure a proper position of terminals of the wiring harnesses relative to a housing of the connector. When the terminals of the wiring harnesses are inserted into the housing, detents disposed on the terminals may be elastically deformed due to interference with small protrusions disposed within the housing, and thereafter snap back to engage with the protrusions disposed within the housing. In this case, when the TPA member is inserted into the housing from, for example, a side surface of the housing, the TPA member may engage with edge portions of the terminals to restrain movement of the terminals. As a consequence of this, the position of the terminals of the wiring harnesses can be properly assured.

In recent years, some relatively large connectors have also been developed, which may be provided with several dozen terminals or poles. These terminals may be consolidated into one or more sub housings or sub connectors depending on various types thereof, such as optical fibers and electrical wires for communication and for power. The sub housing is fitted into a housing body, thereby resulting in a configuration of the connector. The sub housing and the housing body may include corresponding TPA members, respectively. The larger connectors with dozens of terminals typically require a greater force to combine with a mating connector. Accordingly, the larger connectors are generally provided with an insertion-assist mechanism, such as a lever mechanism, in order to reduce a necessary insertion force.

The connectors, which are manufactured by the connector manufacturer as discussed above, are supplied to the harness assembler as they are sets of assembly components, each of which is typically composed of a housing body with a lever, a sub housing, and a TPA member. The assembly components are assembled into connectors, installing wiring harnesses. In the process of assembling the connector with the lever, the wiring harnesses are inserted into the sub housing and fixed with the TPA member, and subsequently the resulting sub connector is installed into the housing body. All of the wiring harnesses are inserted, and thereafter the lever is set up at the predetermined position in order to combine with the mating connector.

In the conventional connector discussed above, however, it has been difficult to verify whether the sub housing is properly installed into the housing body. Accordingly, there has been a problem that the sub housing is not properly installed into the housing body, thereby resulting in deterioration in fundamental performance of the connector. This may include deterioration in reliability of connection.

Additionally, the TPA member inserted into the sub housing has been simply devoted to assuring a proper position of the wiring harnesses relative to the sub housing. Thus, the TPA member has not ultimately assured a proper position of the terminals of the wiring harnesses relative to the housing body. Accordingly, in a case where the sub housing is not installed properly into the housing body, the terminals of the wiring harnesses may be displaced. This may also cause the deterioration in the fundamental performance of the connector.

SUMMARY OF INVENTION

In one aspect of the invention, an electrical connector includes a housing body, a lever, and a terminal position assurance (TPA) member. The housing body includes a front terminal receiving portion to receive terminals of a mating connector and a rear terminal receiving portion to receive a plurality of wiring harnesses. The housing body also includes a TPA slot into which the TPA member is inserted. The lever include an interference portion and is disposed on the housing body so as to rotated within a range between a predetermined position and a final position, thereby functioning as an insertion-assist mechanism. The TPA member is to assure a proper position of the terminals of the wiring harnesses inserted, engaging with the terminals. When the TPA member is improperly inserted into the housing body, the interference portion comes into interference with, in accordance with rotational movement of the lever, a portion of the TPA member that protrudes from the surface of the housing body.

Other aspects and advantages of the invention will be apparent from the following description and the appended claims.

DETAILED DESCRIPTION

Figure 1:
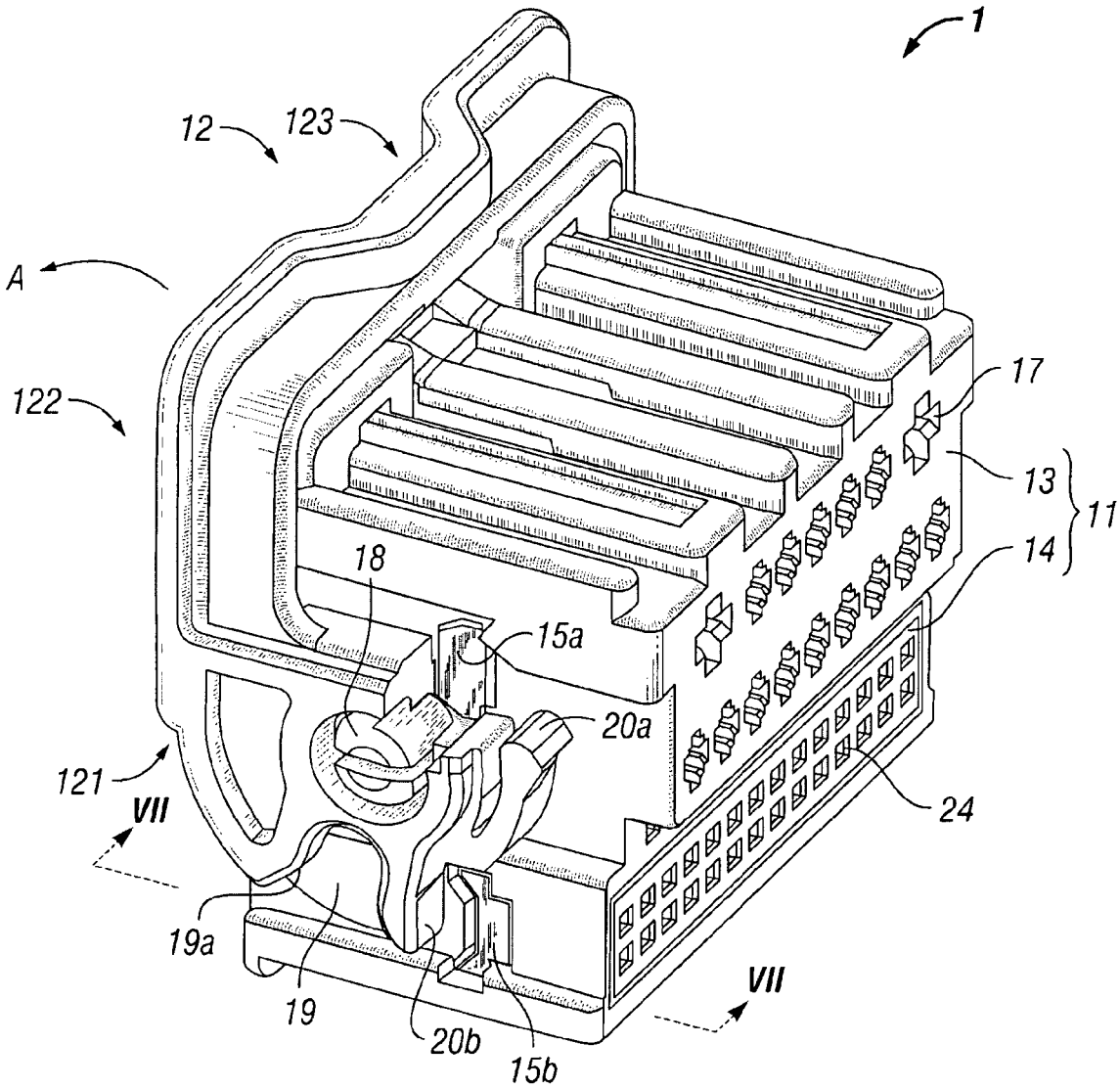
FIG. 1 illustrates a perspective view of an electrical connector with a lever, as the lever is positioned at a final position, according to one embodiment of the invention.
Figure 2:
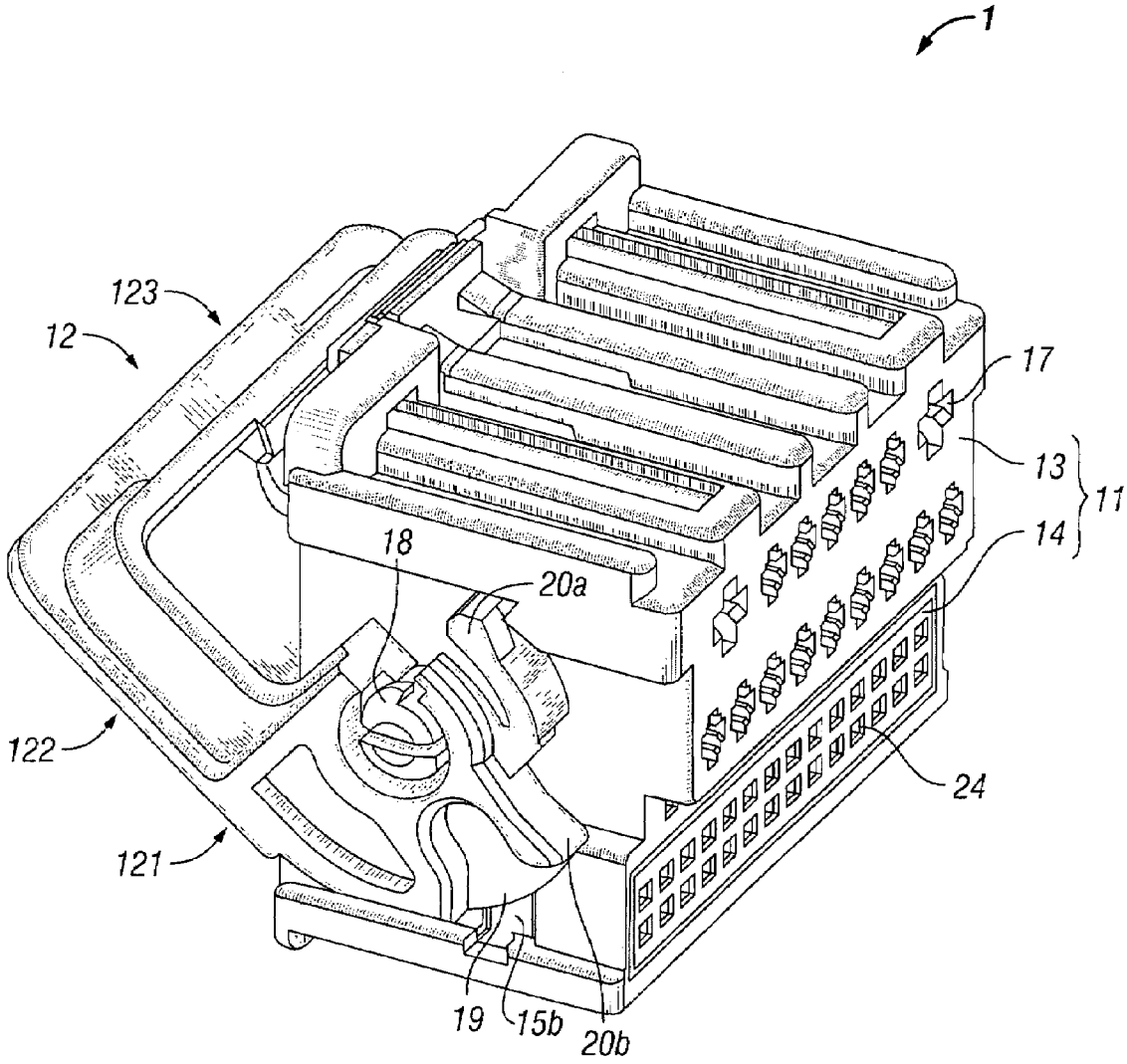
FIG. 2 illustrates a perspective view of the electrical connector, as the lever is positioned at a predetermined position according to one embodiment of the invention.

FIG. 1 illustrates a perspective view of a connector according to one embodiment of the invention. Referring to FIG. 1, a connector 1 is shown as including a female housing 11 with a lever-type insertion-assist mechanism 12. The dimensions of the connector 1 are determined to a large extent by a size and number of terminals or poles. The female connector 11 includes a housing body 13 and a sub housing, which is installed into the housing body 13. At least one TPA member 15 is inserted into the female housing 11. In this embodiment, two types of the TPA members 15*a* and 15*b* are used. The TPA members 15*a* and 15*b* are assembly components to assure a proper position of terminals of wiring harnesses (not shown) inserted into the female housing 11. The lever 12 is disposed on the housing body 13 and configured to be freely rotated. In a process of attaching the wiring harnesses to the female housing 11, the lever 12 is set up at a final position as shown in FIG. 1. In contrast, after assembly into a connector as a final product, as shown in FIG. 2, the lever 12 is set up at a predetermined position by rotating in a direction of an arrow A. The lever 12 may be provided with a lever locking mechanism to prevent the lever 12 from accidentally rotating in the final position.

Figure 3:
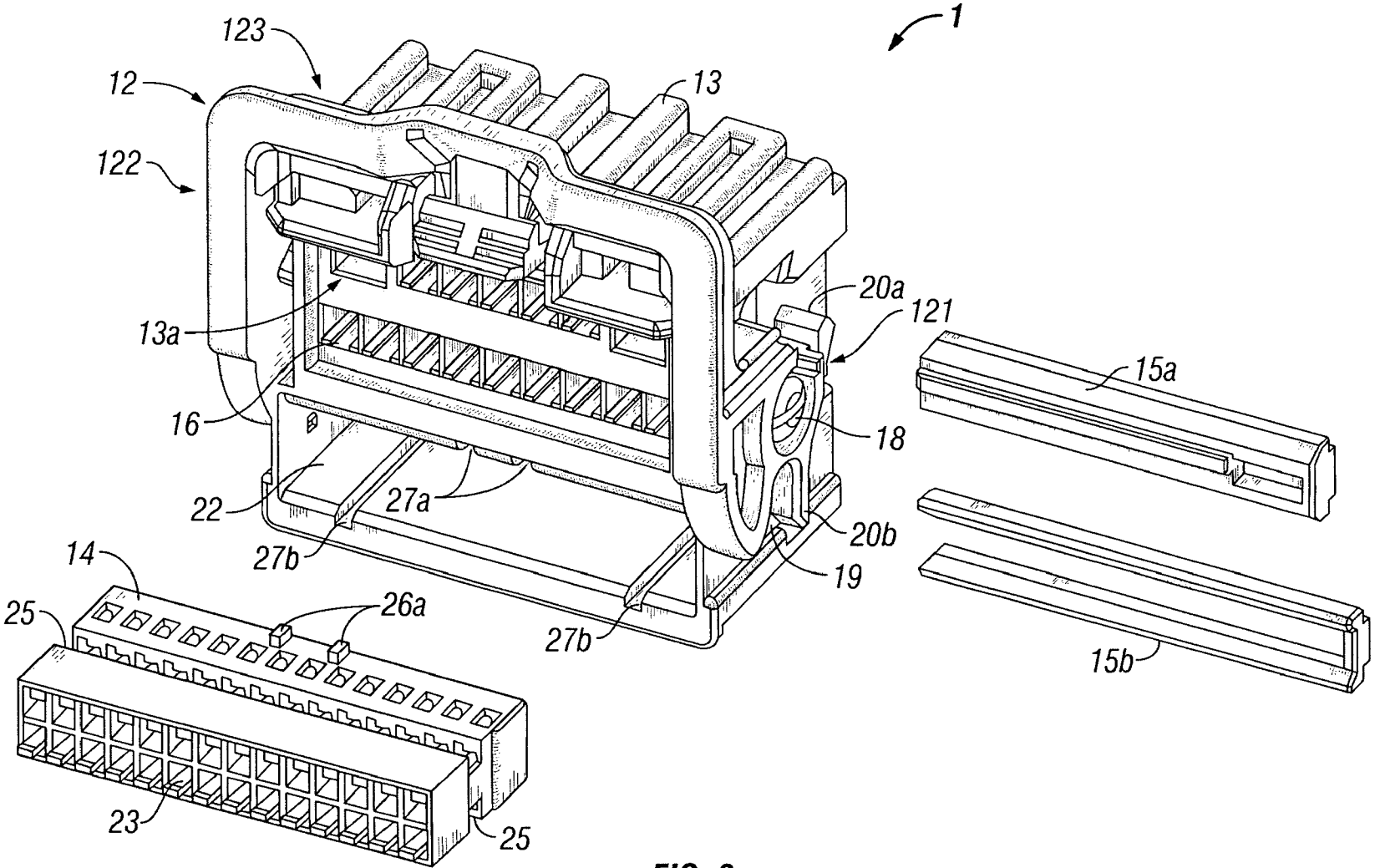
FIG. 3 illustrates an exploded perspective view of the electrical connector shown in FIG. 1.

FIG. 3 illustrates an exploded perspective view of the connector shown in FIG. 1. The housing body 13 is a single-piece component made of insulating material such as plastic, using a molding method. The housing body 13 may alternatively be formed using other known materials and methods. The housing body 13 has a plurality of front terminal slots 16 at a front receiving portion 13*a* thereof. The plurality of front terminal slots 16 are linked to a plurality of rear terminal slots 17 at a rear receiving portion 13*b* of the housing body 13 through passageways disposed within the housing body 13 (also shown in FIG. 1). The rear terminal slots 17 receives the terminals of the wiring harnesses (not shown).

The housing body 13 also includes substantially cylindrical protrusions 18 disposed on both side surfaces thereof, and the lever 12 is supported pivotally by the protrusions 18. The lever 12 primarily serves as an insertion-assist mechanism to reduce an insertion force in combining with a mating connector, i.e., a male connector. In this embodiment, the lever 12 is configured in a roughly inverted U shape such that arm portions 122 extending from base portions 121 that hold the protrusions 18 disposed on the both side surfaces of the housing body 13 support a beam portion 123 at both sides of the beam portion 123.

The base portions 121 include arcuate recesses 19 respectively to accommodate cylindrical bosses disposed on an inner surface of a housing of the mating connector. In combining with the mating connector, the bosses initially come into contact with guide portions 19*a*. Subsequently, by way of rotational movement of the lever 12 in the direction of the arrow A as shown in FIG. 1, the bosses are fitted into the recesses 19, in response to a reactive force between the lever 12 and the boss so as to combine the connector 1 deeply with the mating connector. Accordingly, the insertion-assist mechanism allows an insertion force to be reduced during the process of the combining.

In addition, the base portions 121 include interference portions 20*a* and 20*b*. The interference portions 20*a* and 20*b* are designed so as to move across openings of TPA slots 21*a* and 21*b* as will be described below, in accordance with the rotational movement of the lever 12. Specifically, in a case where any of the TPA members 15*a* and 15*b* is incompletely inserted into the TPA slots 21*a* and 21*b*, a portion of any of the TPA members 15*a* and 15*b* projecting from the TPA slots may come into interference with the interference portion 20*a* and 20*b* so as to restrain the rotational movement of the lever 12. Thus, the lever 12 cannot rotate into the predetermined position, thereby not allowing the connector 1 to be combined with the mating connector. Accordingly, a user or assembler can visibly verify whether the TPA members 15*a* and 15*b* are completely inserted into the female housing 11, thereby preventing incomplete insertion of the TPA members 15*a* and 15*b*.

The housing body 13 includes a sub housing slots 22 to receive the sub housing 14. The sub housing 14 inserted into the housing body 13 forms a part of the female housing 11. It is noted that no sub housing 14 may be needed depending on the requirements of an electrical system in which the connector 1 is installed. In this case, the housing body 13 itself may be equivalent to the female housing 11.

Figure 5:
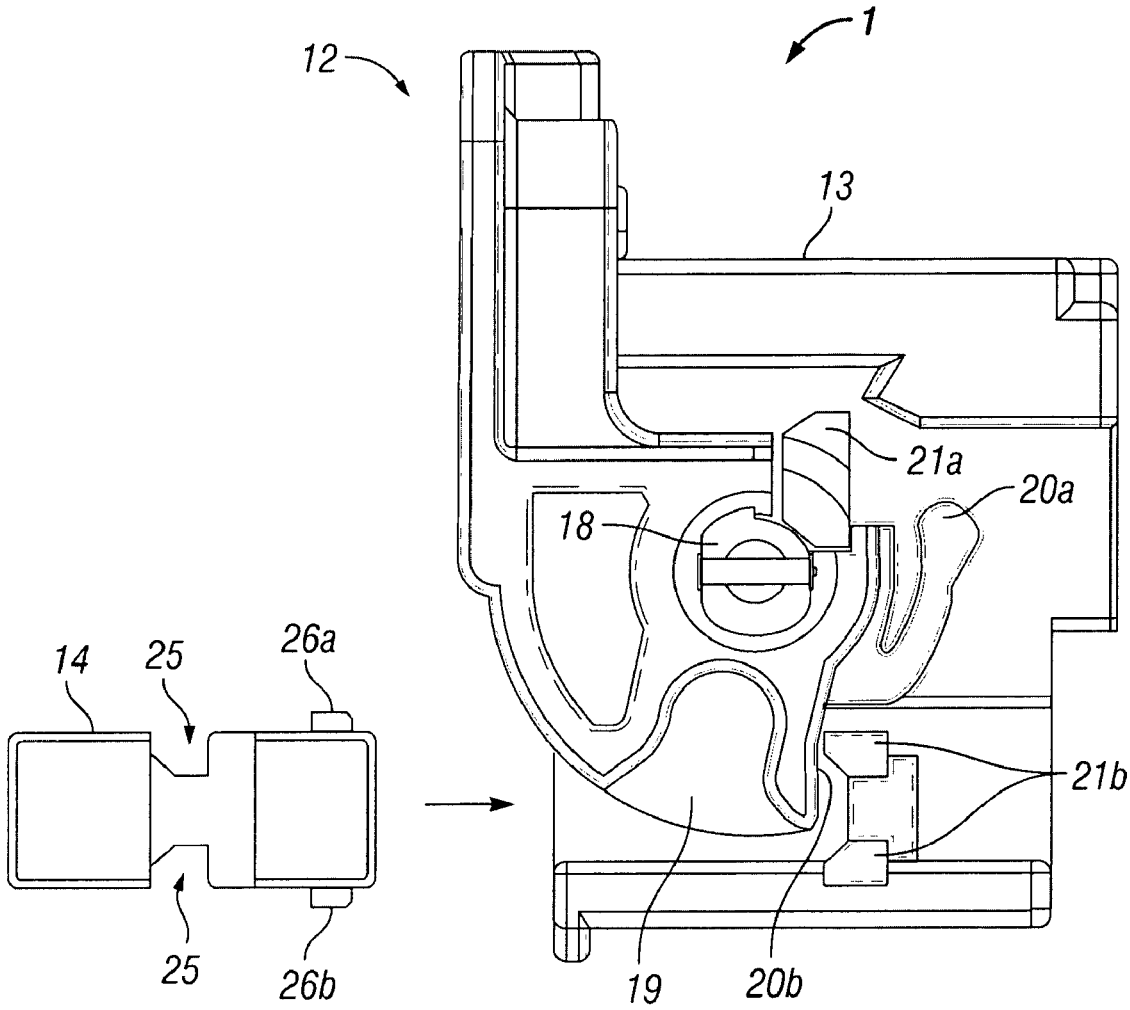
FIG. 5 illustrates a right side view of the electrical connector, as the sub housing is about to be installed into a housing body, according to one embodiment of the invention.

The housing body 13 also includes the TPA slots 21*a* and 21*b*, each of which receives the corresponding TPA members 15*a* and 15*b* as shown in FIG. 5. The TPA member 15*a* is to assure a proper position of terminals of wiring harnesses which are inserted into the rear terminal slots 17 of the housing body 13. On the other hand, the TPA member 15*b* is to assure a proper position of terminals of wiring harnesses which are inserted into the rear terminal slots 17 of the sub housing 14 inserted into the housing body 13. The TPA member 15*a* and 15*b* may be configured in a front-rear asymmetric shape to avoid wrong insertion.

Figure 4A:
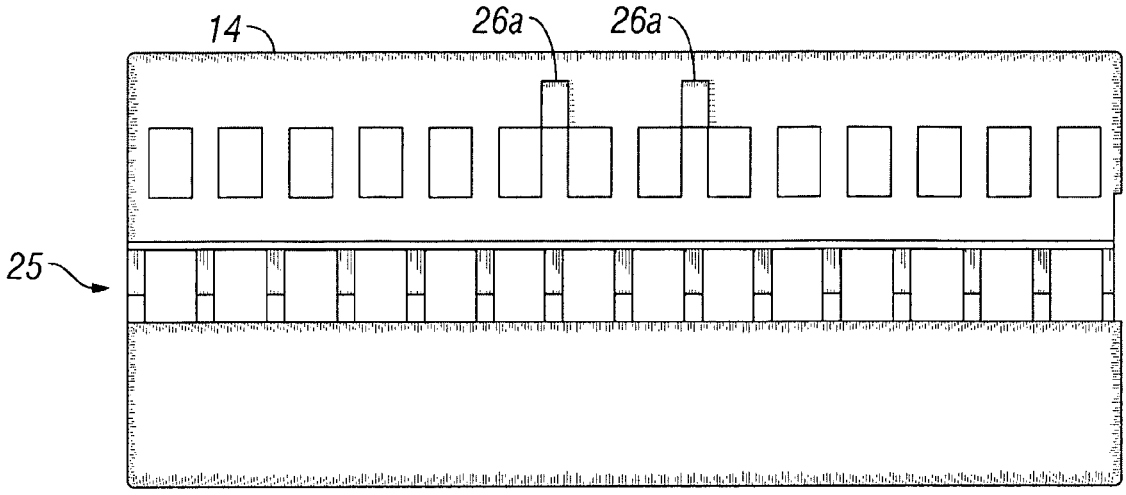
FIG. 4A illustrates a plan view of a sub housing of the electrical connector shown in FIG. 3.
Figure 4B:
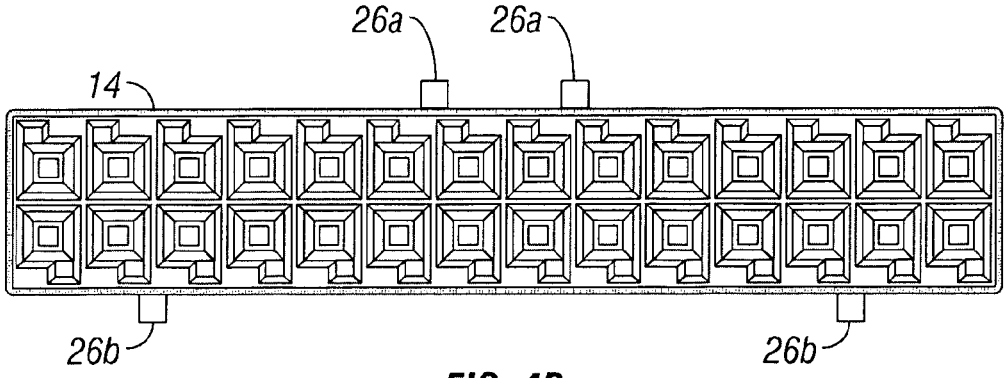
FIG. 4B illustrates a front view of a sub housing of the electrical connector shown in FIG. 3.
Figure 4C:
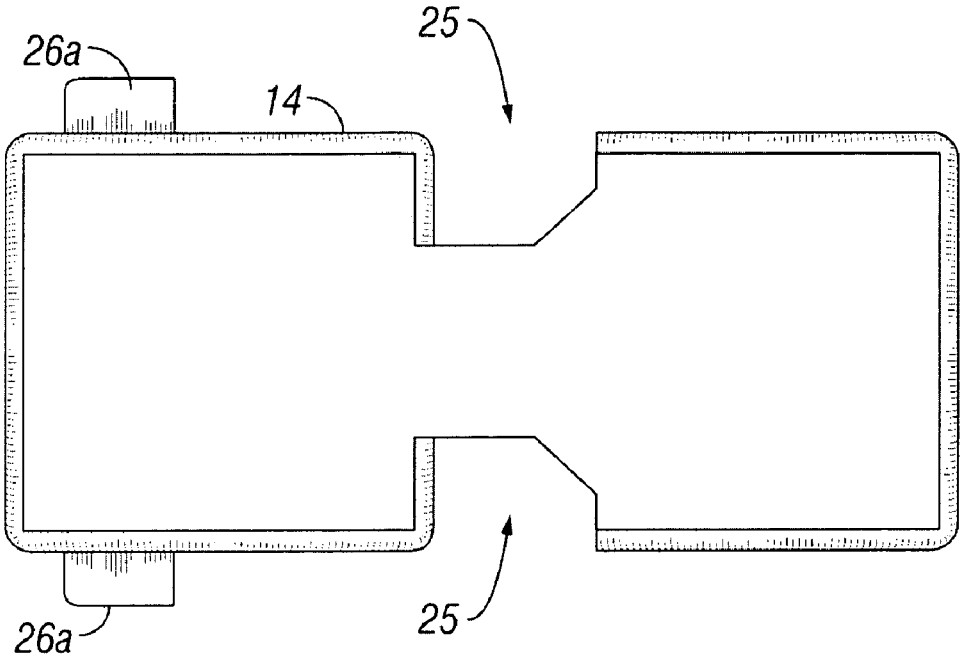
FIG. 4C illustrates a left side view of the sub housing of the electrical connector shown in FIG. 3.
Figure 4D:
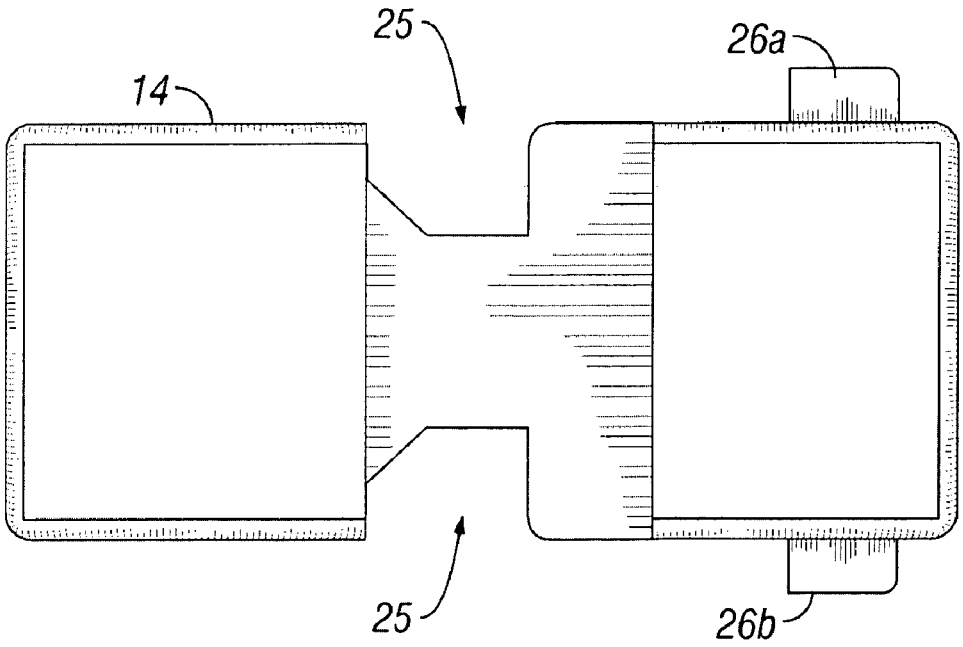
FIG. 4D illustrates a right side view of a sub housing of the electrical connector shown in FIG. 3.
Figure 6:
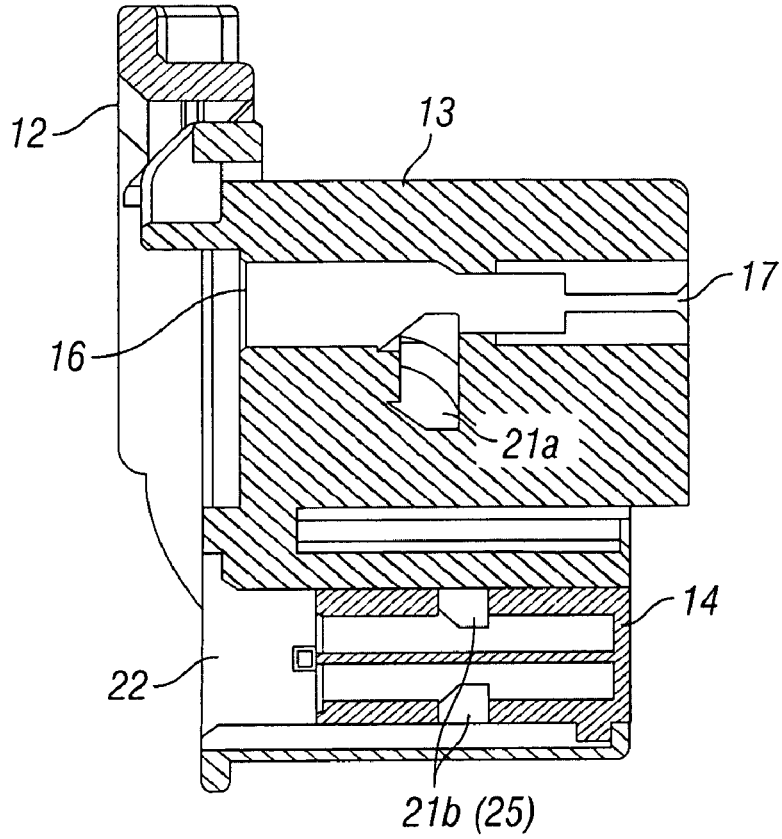
FIG. 6 illustrates a cross-sectional view of the electrical connector in which the sub housing is installed into the housing body according to one embodiment of the invention.

FIGS. 4A through 4D illustrate a configuration of the sub housing 14 shown in FIG. 3 in great detail. The sub housing 14 may also be a single-piece component made of insulating material such as plastic. Referring now to FIG. 4B, the sub housing 14 includes a plurality of front terminal slots 23 disposed on a front receiving portion thereof and a plurality of rear terminal slots 24 disposed on a rear receiving portion thereof, which are linked to the plurality of front terminal slots 23 through passageways disposed within the sub housing 14. The sub housing 14 also includes grooves 25 extending in a transverse direction thereof, which are disposed on a top surface and a bottom surface of the sub housing 14. The grooves 25 is for receiving and engaging with the TPA member 15*b*. As apparent from FIGS. 5 and 6, the size and shape of the grooves 25 in a side view of the sub housing 14 conform to that of the TPA slot 21*b*. Thus, when the sub housing 14 is properly inserted into the housing body 13, the TPA slot 15*b* and the grooves 25 align, thereby allowing the TPA member 15*b* to be inserted therein.

Figure 7:
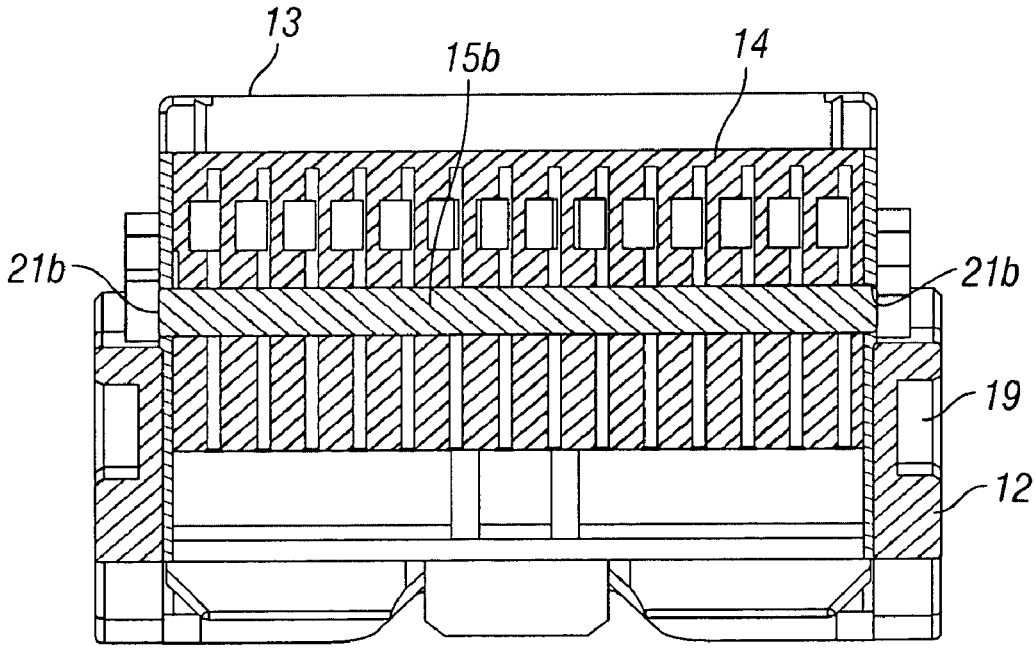
FIG. 7 illustrates a cross-sectional view of the electrical connector 1 along the lines VII—VII shown in FIG. 1.

FIG. 7 illustrates a cross-sectional view of the connector 1 along the B–B' line shown in FIG. 1, as best showing the TPA member 15, which is inserted into the sub housing 14 inserted into the housing body 13. Referring to FIG. 7, both end portions of the TPA member 15*b* engage with openings of the TPA slots 21*b*, thereby allowing the sub housing 14 to be fixed to the housing body 13.

Referring back to FIG. 4A, the sub housing 14 also includes projections 26*a* and 26*b* disposed on the top surface and the bottom surface thereof for preventing the sub housing 14 from being inserted upside down. The projections 26*a* and 26*b* correspond to grooves 27*a* and 27*b* disposed on an inner surface of the sub housing 14 (FIG. 3). The projections 26*a* and 26*b* and the grooves 27*a* and 27*b* are disposed asymmetrically, thereby preventing wrong insertion of the sub housing 14 into the housing body 13.

One of the features of embodiments of the invention is characterized in that, when any of the TPA members 15*a* and 15*b* is not completely inserted into the female housing 11, either of the interference portions 20*a* and 20*b* of the lever 12 comes into interference with any of the end portions of the TPA members 15*a* and 15*b*, thereby restraining rotational movement of the lever 12. If the lever 12 is set at the predetermined position, the TPA member 15*a* and 15*b* are deemed to be completely inserted into the female housing 11. Further, the TPA member 15*b* relative to the sub housing 14 is inserted into the housing body 13 through the TPA slot 21*b* after the sub housing 14 is inserted into the housing body 13. Accordingly, if the TPA member 15 is not completely inserted into the female housing 11, the interference portion 20*b* of the lever 12 comes into interference with the end portion of the TPA member 15, in accordance with rotational movement of the lever 12, thereby preventing the lever 23 from rotating.

Figure 8A:
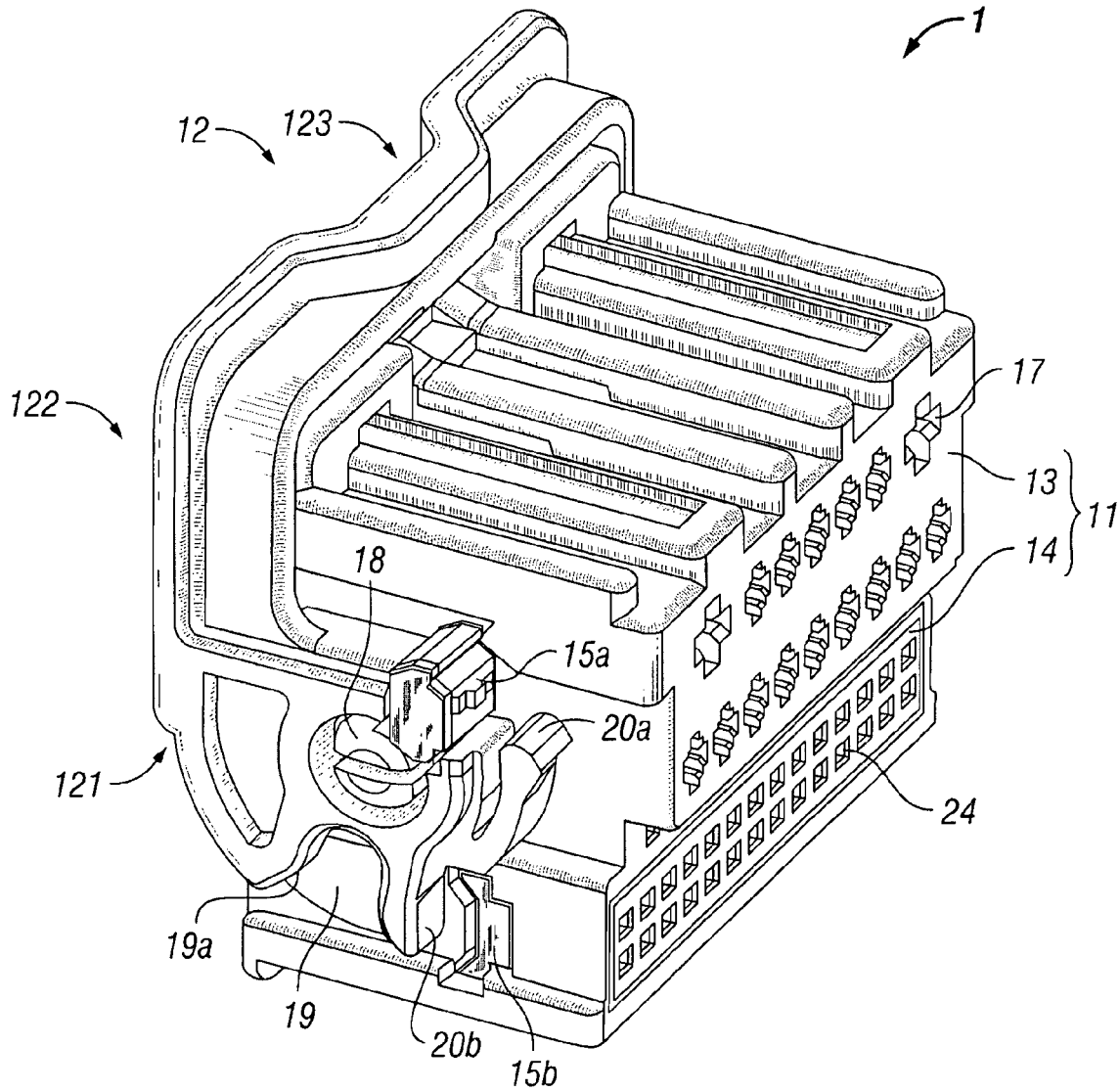
FIGS. 8A and 8B illustrate conditions that any of TPA members is incompletely inserted into the electrical connector according to one embodiment of the invention.
Figure 8B:
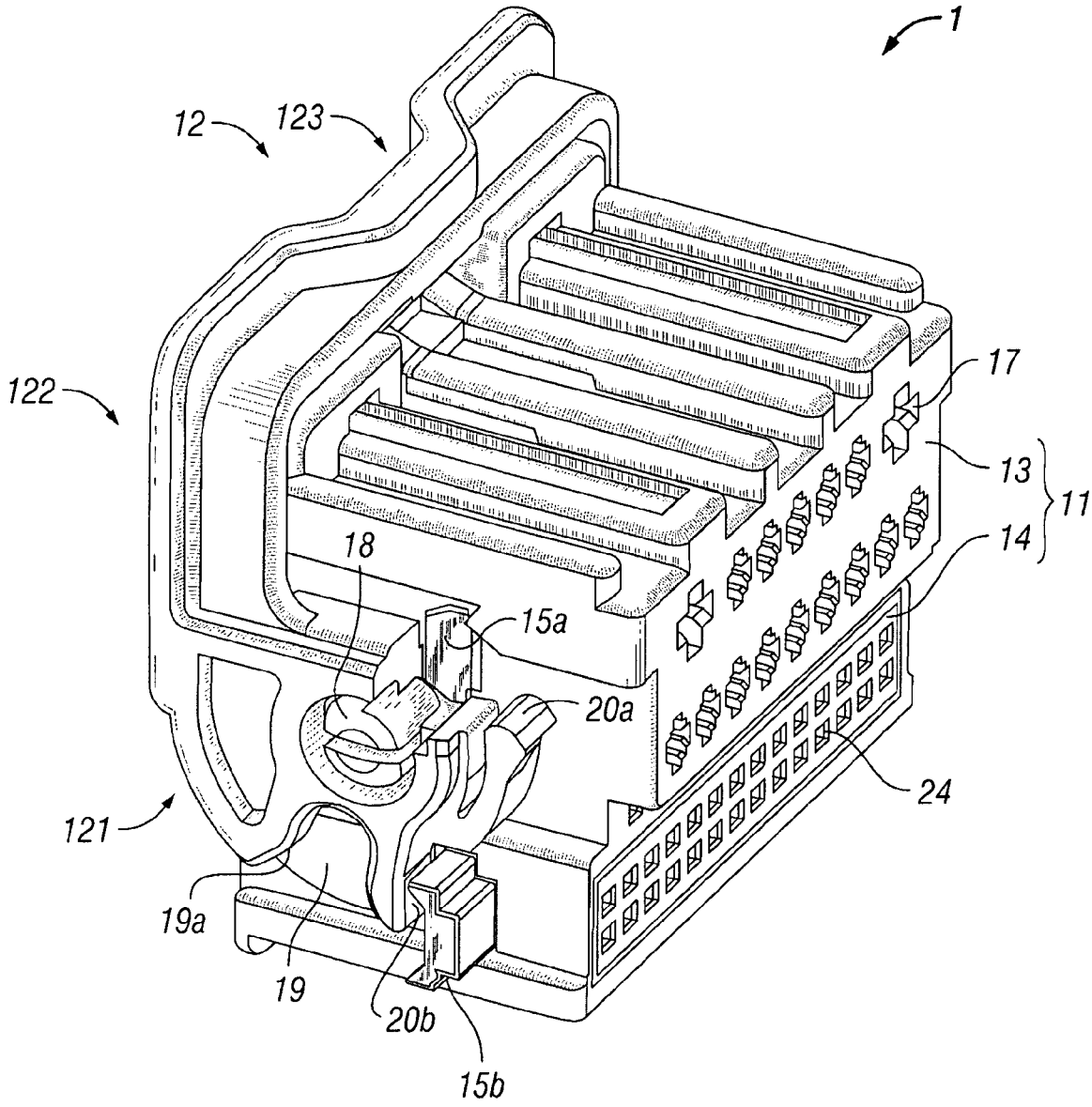

FIGS. 8A and 8B illustrate perspective views of the connector 1 in interference of the lever 12 with any of the TPA member 15*a* and 15*b*. It is noted that the wiring harnesses are omitted from these figures. In an actual process of assembling into the connector 1, both of the TPA members 15*a* and 15*b* may be incompletely inserted into the female housing 11 simultaneously.

Referring to FIG. 8A, when the TPA member 15*a* is not completely inserted into the TPA slot 21*a* of the housing body 13, an end portion of the TPA member 15*a* protrudes from the side surface of the housing body 13. In such circumstances, when the lever 12 is rotated, the interference portion 20*a* of the lever 12 comes into interference with the end portion of the TPA member 15*a*, thereby restraining rotational movement of the lever 12.

In the meantime, as shown in FIG. 8B, when the TPA member 15*b* is not completely inserted into the TPA slot 21*b* of the housing body 13, an end portion of the TPA member 15*b* protrudes from the side surface of the housing body 13. In such circumstances, when the lever 12 is rotated, the interference portion 20*a* of the lever 12 comes into interference with the end portion of the TPA member 15*b*, thereby restraining rotational movement of the lever 12.

As a result of the various configurations described in detail above, embodiments of the invention may include one or more following advantages, some of which have been discussed above. According to one embodiment of the invention, for example, a base portion of a rotatable lever includes an interference portion. If a TPA member is not completely inserted into a female housing, the interference portion comes into interference with an end portion of the TPA, which protrudes from a surface of the female housing, thereby restraining the rotational movement of the lever. Thus, if the lever is properly set at a predetermined position by rotating the lever, the TPA member is deemed to be completely inserted into the female housing. Accordingly, an user or assembler can easily verify whether the TPA member is completely inserted into the female housing.

Further, according to one embodiment of the invention, a connector with a lever is configured such that a TPA member relative to a sub housing is inserted into a female housing through a TPA slot of a housing body after the sub housing is inserted into the housing body. Thus, this configuration does not allow the TPA member to be inserted unless the sub housing is completely inserted into the housing body. This is because the TPA slot is not overlapping with grooves disposed on the sub housing. In addition, even if the TPA member is inserted into the female housing but not completely, an interference portion of the lever comes into interference with an end portion of the TPA member, in accordance with rotational movement of the lever, thereby restraining the rotational movement of the lever. Thus, when the lever is properly set at a predetermined position, the TPA member is deemed to be completely inserted, thereby allowing a user or assembler to easily verify whether the TPA member is completely inserted. Further, as a consequence of this, the position of terminals of wiring harnesses, which are inserted into the sub housing, relative to the housing body is ultimately assured. Accordingly, performance of connector including reliability for connection is assured.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a housing body having a front terminal receiving portion to receive terminals of a mating connector and having a rear terminal receiving portion to receive a plurality of wiring harnesses, wherein a first TPA slot is disposed on a surface of the housing body;

a first terminal position assurance member configured to be inserted into the first TPA slot, wherein the first terminal position assurance member engages terminals of the plurality of wiring harnesses inserted from the rear terminal receiving portion; and a lever supported pivotally by a protrusion within a range between a first position and a second position, wherein the lever has at least one interference portion configured to interfere with, in accordance with rotational movement of the lever, a portion of the first terminal position assurance member that protrudes from the surface of the housing body when the first terminal position assurance member is improperly inserted, and wherein when the first terminal position assurance member is properly inserted and does not protrude from the surface of the housing body, the at least one interference portion of the lever does not interfere with, in accordance with rotational movement of the lever, the portion of the first terminal position assurance member.

2. The connector according to claim 1, further comprising:

a sub housing having a front terminal receiving portion to receive terminals of a mating connector and having a rear terminal receiving portion to receive the plurality of wiring harnesses, wherein the sub housing is installed into a sub housing slot formed on the housing body.

3. A connector comprising:

a housing body having a front terminal receiving portion to receive terminals of a mating connector and having a rear terminal receiving portion to receive a plurality of wiring harnesses, wherein a first TPA slot is disposed on a surface of the housing body;

a first terminal position assurance member configured to be inserted into the first TPA slot, wherein the first terminal position assurance member engages terminals of the plurality of wiring harnesses inserted from the rear terminal receiving portion;

a lever supported pivotally by a protrusion within a range between a first position and a second position, wherein the lever has at least one interference portion configured to interfere with, in accordance with rotational movement of the lever, a portion of the first terminal position assurance member that protrudes from the surface of the housing body when the first terminal position assurance member is improperly inserted;

a sub housing having a front terminal receiving portion to receive terminals of a mating connector and having a rear terminal receiving portion to receive the plurality of wiring harnesses, wherein the sub housing is installed into a sub housing slot formed on the housing body; and a second terminal position assurance member configured to engage the sub housing.

4. The connector according to claim 3, wherein one of the interference portions comes into interference with, in accordance with the rotational movement of the lever, a portion of the second terminal position assurance member that protrudes from the surface of the housing body when the second terminal position assurance member is improperly inserted.

5. The connector according to claim 3, wherein an end portion of the second terminal position assurance member engages with an edge portion of the second TPA slot.

6. The connector according to claim 3, wherein the sub housing includes a groove to engage with the second terminal position assurance member.

7. The connector according to claim 6, wherein a second TPA slot is disposed on the housing body, and the second terminal position assurance member is inserted into the second TPA slot.

8. The connector according to claim 6, wherein a size and shape of the second TPA slot substantially conforms to a size and shape of cross section of the groove.

9. A method of assembling a connector, comprising:

inserting terminals of a plurality of wiring harnesses into a plurality of a terminal slots disposed on a rear terminal receiving portion of a housing body;

inserting a first terminal position assurance member into a first TPA slot disposed on the housing body to engage the terminals of the plurality of wiring harnesses;

rotating a lever having at least one interference portion and supported pivotally by a pivot disposed on the housing body until a predetermined position, wherein the interference portion comes into interference with a portion of the first terminal position assurance member that protrudes from the surface of the housing body when the first terminal position assurance member is improperly inserted, and wherein when the first terminal position assurance member is properly inserted and does not protrude from the surface of the housing body, the at least one interference portion of the lever does not interfere with, in accordance with rotational movement of the lever, the portion of the first terminal position assurance member.

10. The method according to claim 9, further comprising:

setting a lever up at a final position before the first terminal position assurance member is inserted into the first TPA slot.

11. The method according to claim 9, further comprising:

installing a sub housing inserting terminals of the plurality of wiring harnesses therein into a sub housing slot disposed on the housing.

12. A method of assembling a connector, comprising:

inserting terminals of a plurality of wiring harnesses into a plurality of a terminal slots disposed on a rear terminal receiving portion of a housing body;

inserting a first terminal position assurance member into a first TPA slot disposed on the housing body to engage the terminals of the plurality of wiring harnesses;

rotating a lever having at least one interference portion and supported pivotally by a pivot disposed on the housing body until a predetermined position, wherein the interference portion comes into interference with a portion of the first terminal position assurance member that protrudes from the surface of the housing body when the first terminal position assurance member is improperly inserted;

installing a sub housing inserting terminals of the plurality of wiring harnesses therein into a sub housing slot disposed on the housing; and inserting a second terminal position assurance member into a second TPA slot disposed on the housing body, thereby engaging the second terminal position assurance member with the terminals of the plurality of wiring harnesses installed into the sub housing.

13. The method according to claim 12, wherein the second terminal position assurance member engages with a groove disposed on the sub housing.

14. The method according to claim 12, wherein one of the interference portions comes into interference with, in accordance with the rotational movement of the lever, a portion of the second terminal position assurance member that protrudes from the surface of the housing body when the second terminal position assurance member is improperly inserted.

* * * * *